United States Patent [19]

Nilsson et al.

[11] Patent Number: 4,711,552

[45] Date of Patent: Dec. 8, 1987

[54] SYNCHRONIZING ELECTROSTATIC COPY FORMATION

[75] Inventors: Ben A. Nilsson, Boulder; Roger D. Shepherd, Rollinsville, both of Colo.

[73] Assignee: International Business Machines Corporation, Armonk, N.Y.

[21] Appl. No.: 864,406

[22] Filed: May 19, 1986

[51] Int. Cl.[4] ..... G03G 15/00

[52] U.S. Cl. ..... 355/3 R; 355/8; 355/14 SH; 355/14 R

[58] Field of Search ..... 355/3 R, 8, 14 R, 14 SH, 355/14 C

[56] References Cited

U.S. PATENT DOCUMENTS

| | | | |
|---|---|---|---|
| 4,026,647 | 5/1977 | Kanno et al. | 355/8 |
| 4,203,663 | 5/1980 | Ogura et al. | 355/14 C |
| 4,422,751 | 12/1983 | Komiya et al. | 355/14 SH |
| 4,536,079 | 8/1985 | Lippolis et al. | 355/14 R |
| 4,538,905 | 9/1985 | Griego et al. | 355/14 SH |
| 4,627,721 | 12/1986 | Nguyen et al. | 355/14 R |

*Primary Examiner*—Arthur T. Grimley
*Assistant Examiner*—J. Pendegrass
*Attorney, Agent, or Firm*—Perman & Green

[57] ABSTRACT

In an electrophotographic copier, adjustments are made to synchronize copy sheet gating optics start of scan, and document conveyor registration. The adjustment to the copy sheet gating is effected by making a copy with the optics assembly inactivated, determining the length of undeveloped area adjacent to the leading or trailing edge of the copy, and adjusting the start of scan as a function of the determined length. The start of scan of the optics assembly is effected by positioning a test master document with dark portions adjacent to its leading and trailing edges, making a copy of the test master document, determining the length of undeveloped area adjacent to the leading or trailing edge of the copy, and adjusting the start of scan as a function of the determined length. The adjustment of the document conveyor registration is effected by feeding the test master document to the document glass, making a copy of the test master document, determining the length of undeveloped area adjacent to the leading or trailing edge of the copy, and adjusting the document conveyor as a function of the determined length. The determining steps may be done by visual inspection or by an optical sensor. The adjusting may be done manually, either electronically or mechanically. In the alternative, the adjusting may be done automatically in response to the optical sensor.

30 Claims, 2 Drawing Figures

SYNCHRONIZING ELECTROSTATIC COPY FORMATION

BACKGROUND OF THE INVENTION

I. Field of the Invention

This invention relates to copiers and, more particularly, to a method and apparatus for monitoring and adjusting various components of electrophotographic copiers to improve their synchronous operation.

II. Background of the Invention

In the process of electrophotography, a cylindrical drum is formed with a photoreceptor surface. The surface is sequentially rotated past a plurality of electrophotographic processing stations whereby the image on an original document may be reproduced onto a copy sheet. In the normal mode of carrying out the process, the photoconductor surface is uniformly charged and then exposed to light rays imaged from the original document to dissipate the charge in areas corresponding to the non-image areas and to allow the charge to remain in the image areas. A latent electrostatic image is thus formed on the photoreceptor corresponding to the image on the original document. Prior to development of the latent electrostatic image, portions of the photoreceptor between electrostatic images are subjected to light from an electroluminescent panel to dissipate the charge on these light-struck portions of the photoreceptor to preclude unnecessary development. The latent electrostatic image is then passed through a development station where dark toner particles, electrostatically charged opposite from the charge of the electrostatic image, are brought into contact with the electrostatic image for its development. The developed image on the photoreceptor surface then moves past a transfer station whereat a sheet of copy paper is fed synchronously into contact with the developed image of the drum. At the transfer station, the toner image is electrostatically transferred from the photoreceptor to the copy sheet. The copy paper is then moved through a fusing device to permanently affix the toner image thereto for the creation of the permanent image. The photoreceptive surface is then cleaned as it passes to the charging station and other subsequent processing stations to complete a cycle of operation and begin a new cycle.

As can be understood, the synchronization of the various electrophotographic processing steps is vital to the creation of a high quality reproduction of the original document. It is equally vital that the copy sheet and the photoreceptor are fed in synchronism with the leading edge of the paper in exact registration with the leading edge of the electrostatic image, that the optical assembly is adjusted to project the optical image from the leading edge to the trailing end of the original document, and that the document conveyor transports the original document onto the document glass of the copier at the correct location. If the copier is adjusted improperly so that one or more of these occurrences is not synchronously effected, a full one-to-one copy of the entire original document cannot be achieved.

Various prior patents disclose methods and apparatus intended to achieve adjustments of the same copier components as those to be adjusted by the present invention. For example, U.S. Pat. No. 4,310,236 to Connin relates to feeding copy sheets to an electrophotographic web so that the copy sheets can be positioned to compensate for positional deviations of the document images from the normal or expected image position. The copy sheet can be adjusted to deliberately provide skew in the copy sheet. There is no provision, however, for adjusting the side edge of the copy sheet. In the preferred embodiment, sensors in the document feeder determine if the document has not been properly positioned on the document glass. This patent, therefore, does not relate to adjustments at initial machine setup but rather to in-process alteration of copy sheet feeding in accordance with document positioning on the document glass.

A technique for mating the leading edge of the copy sheet with the leading edge of the electrostatic image is disclosed in U.S. Pat. No. 4,203,663 to Ogura et al. Like the previously discussed patent, this disclosure is not applicable to adjustments at initial machine setup.

In U.S. Pat. No. 4,272,187 to Birdsall et al, a manufacturing process is disclosed for aligning optical elements within a copier machine through the use of a vidissector camera. This disclosure relates to a manufacturing process and is not pertinent to adjustments at initial machine setup.

Lastly, U.S. Pat. No. 4,243,316 to Gustafson relates to a registration mechanism for a master document on the document glass. Here, once again, the disclosure is not applicable to adjustments at initial machine setup.

As illustrated by the great number of prior patents, efforts are continuously being made in an attempt to accurately and conveniently create a complete and exact copy of an original document automatically through a proper timing sequence of components of the copier. Nothing in the prior art discloses or suggests the present inventive combination of method steps and apparatus for completely and exactly creating copies of original documents through various adjustments to effect the precisely synchronized operation of certain critical components of the copier.

The present invention achieves its purposes, objectives, and advantages over the prior art through a new, useful, and unobvious combination of components for synchronously conveying an original document to the document glass, the projecting of the image of the original document to the photoreceptor, and feeding of the copy sheet to the electrostatic image in a convenient and repeatable manner. All of this is accomplished with a minimum number of functioning parts, at a minimum of cost, and through the utilization of only readily available materials and conventional components.

These objectives and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary of the invention and detailed description describing the preferred embodiments of the invention in addition to the scope of the invention as defined by the claims taken in conjunction with the accompanying drawings.

SUMMARY OF THE INVENTION

The present invention is defined by the appended claims with the specific preferred embodiments shown in the attached drawings. For the purposes of summarizing the invention, the invention may be incorporated into a method for synchronizing the movement of the leading edge of a copy sheet and the movement of the leading edge of an electrostatic image of a photoreceptor in an electrophotographic copier. The method includes the steps of inactivating the optics assembly of the copier, initiating the copying cycle of the copier to produce a copy with the optics assembly inactivated, determining the length of undeveloped area adjacent to the leading edge or the trailing edge of the copy, and adjusting the gating of the copy sheet as a function of any such length. The method further includes the steps of reactivating the optical assembly, positioning a master document with a colored area adjacent to its leading edge and a colored area adjacent to its trailing edge on the document glass of the copier, initiating the copying cycle of the copier to produce a copy, determining the length of undeveloped area adjacent to the leading edge or trailing edge of the copy, and adjusting the start of scan of the optics assembly as a function of any such length.

At least one of the determining steps may be effected by visual observation and at least one of the adjusting steps may be effected manually. In the alternative, at least one of the determining steps may be effected automatically by a sensor in the path of travel of the copy and at least one of the adjusting steps may be effected automatically in response to the sensor. In another alternative, both of the determining steps may be effected by visual observation and both of the adjusting steps may be effected manually. In the alternative, both of the determining steps may be effected automatically by a sensor in the path of travel of the final copy and both of the adjusting steps may be effected automatically by the control system in response to the sensor.

The method further includes the step of conveying a master document with a colored area adjacent to its leading edge and a colored area adjacent to to its trailing edge by a document feeder onto the document glass of the copier, initiating the copying cycle of the copier to produce a copy, determining the length of undeveloped area adjacent to the leading edge and trailing edge of the copy, and adjusting the document feeder as a function of any such length. At least one of the determining steps may be effected by visual observation and at least one of the adjusting steps may be effected manually. In the alternative, at least one of the determining steps may be effected automatically by a sensor in the path of travel of the copy and at least one of the adjusting steps may be effected automatically in response to the sensor. In another alternative, all of the determining steps may be effected by visual observation and all of the adjusting steps are effected manually. In yet another alternative, all of the determining steps may be effected automatically by a sensor in the path of travel of the final copy and all of the adjusting steps may be carried out automatically in response to the sensor.

The invention may also be considered as including apparatus, in an electrophotographic copier, for synchronizing the movement of the leading edge of the copy sheet and the movement of the leading edge of the electrostatic image on the photoreceptor. This apparatus comprises an optics assembly control means to activate and inactivate the optics assembly of the copier; start means to initiate the copying cycle of the copier to produce a copy with the optics assembly activated or inactivated; document glass means to support a master document with a colored area adjacent to its leading edge and a colored area adjacent to its trailing edge; sensor means to determine the length of undeveloped area adjacent to the leading edge or trailing edge of the copy; and adjustment control means adapted to automatically adjust the gating of the copy sheet in response to the sensor means as a function of any sensed length when the optics assembly is inactivated and to automatically adjust the start of scan of the optics assembly in response to the sensor means as a function of any sensed length when the optics assembly is activated. The sensor means is preferably an optical sensor. The apparatus further includes document conveyor means to transport a master document with a colored area adjacent to its leading edge and a colored area adjacent to its trailing edge onto the document glass of the copier. The adjustment control means is also adapted to automatically adjust the document conveyor means in response to the sensor means as a function of any sensed length when both the document conveyor means and optical assembly are activated. The sensor means is preferably an optical sensor.

The invention may also be incorporated into an electrophotographic copier comprising a photoreceptor movable through a plurality of processing stations; a charging station whereat a uniform electrostatic charge is deposited onto the photoreceptor; an exposure station including a document glass for supporting an original document with a colored area adjacent to its leading edge and a colored area adjacent to its trailing edge and whereat light rays reflected from the original document dissipate the charge on an image panel of the photoreceptor in a configuration corresponding to the original document thus creating an electrostatic image; an erase station whereat an electroluminescent strip dissipates the charge between image panels; a developing station whereat toner particles are deposited onto the photoreceptor to develop the electrostatic image; a transfer station whereat toner particles on the photoreceptor are transferred onto a copy sheet; a copy sheet feed means to convey a copy sheet to an image panel of the photoreceptor with their leading edges in synchronism; fusing means whereat the toner particles on the copy sheet are permanently affixed thereto for creating the copy of the original document; an optical sensor in the path of travel of the copy beyond the fusing means to determine the length of the undeveloped area on the copy adjacent to the leading or trailing edge; and adjustment control means responsive to the length determined by the optical sensor to adjust the gating of the copy sheet feed means when the optical assembly is inactivated and to adjust the start of the optical assembly when the optical assembly is activated. The copier further includes an automatic document feeder to convey, to a predetermined position on the document glass, an original document with a colored area adjacent to its leading edge and a colored area adjacent to its trailing edge. The adjustment control means is responsive to any such length determined by the optical sensor to adjust the automatic document feeder when the optical assembly and the document feeder are both activated.

The foregoing has outlined rather broadly the more pertinent and important features of the present invention in order that the detailed description of the invention that follows may be better understood whereby the present contribution to the art can be more fully appreciated. Additional features of the invention will be described hereinafter which form the subject of the claims of the present invention. It should be appreciated by those skilled in the art that the conception and the specific embodiments disclosed herein may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the nature, objects, and advantages of the present invention, reference should be had to the following detailed description taken in conjunction with the accompanying drawing in which.

Similar reference numerals refer to similar parts throughout the drawings.

DETAILED DESCRIPTION OF THE INVENTION

Figure 1:
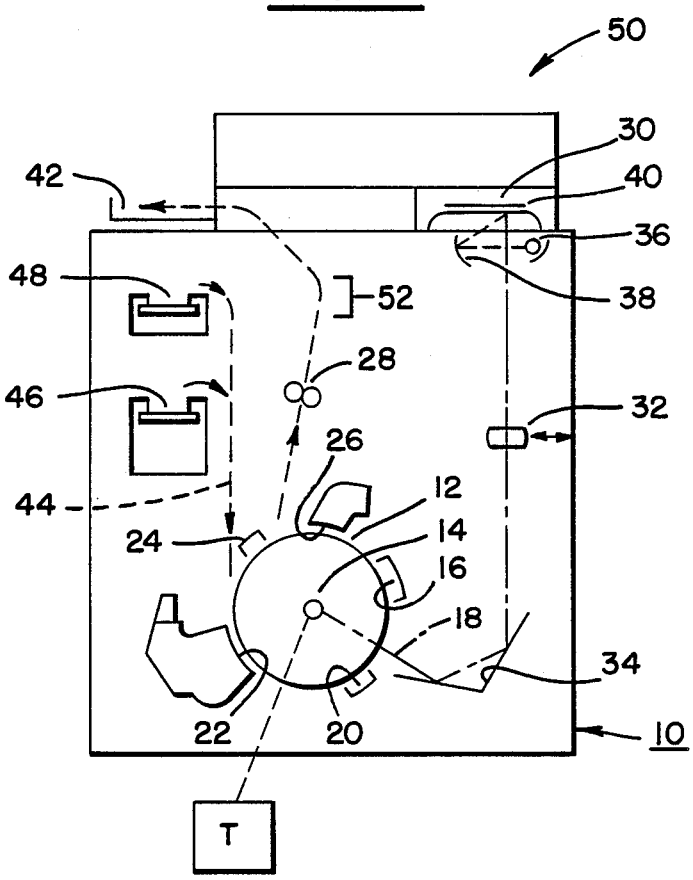
FIG. 1 is a side elevational view of a representative electrophotographic copier for carrying out the method of the present invention and incorporating the apparatus of the present invention.

FIG. 1 is a side elevational view of an electrophotographic copier incorporating the adjustment apparatus, and capable of carrying out the adjustment method, of the present invention. The copier maybe of any suitable type and details of the electrophotographic process are well known to those skilled in the art and form no part of this invention. It is to be understood that a variety of methods and apparatus other than those described therein exist for performing the various electrophotographic process functions.

With reference to FIG. 1, electrophotographic copier 10 includes a photoconductor 12 formed as a drum providing an image receiving photoconductor surface. The drum is mounted for rotation about a shaft 14 to sequentially move portions of the drum through the various electrophotographic processing stations in a particular timed sequence. The drum includes an exterior surface of a photoconductive material which retains charge in the dark but dissipates charge in those areas which are exposed to light. The photoconductive material is supported on a grounded, electrically conductive substrate to effect such dissipation. A given area of the drum 12 is sequentially rotated past a charging station 16, an exposure station 18, an erase station 20, a development station 22, a transfer station 24, a cleaning station 26, and adjacent to a fusing assembly 28.

At the charging station 16, a uniform electrostatic charge is continuously applied to the photoconductor passing therebeneath. The charging is effected through a charged wire electrically biased with respect to the grounded substrate of the photoreceptor to effect a corona discharge. The charge is uniformly retained on the photoreceptor so long as the photoreceptor is not exposed to light.

The exposure station 18 projects light images which discharge a working area of photoconductor in accordance with the reflectance characteristic of a stationary original document 30. Document 30 is line-scanned by movable lens 32 and reflector 34. Light source 36 cooperates with reflector 38 to illuminate the original document with a footprint of light. This light footprint extends normal to the scan direction. Document 30 is placed on document glass 40 within its length dimension normal to the scan direction. The area of photoconductor drum 12 which is line-scanned by this reflected footprint is defined as the photoconductor's working area or image panel referred to above. It is the area which contains the reflected image to be reproduced, and which will coincide with a copy sheet at the transfer station 24.

That portion of the photoreceptor adapted to receive the imaged representation of the original constitutes the working area or image panel. It extends for a substantial axial portion of the drum and partially around the drum circumferentially. An erase station in the form of an electroluminescent panel 20 is next positioned adjacent to the photoreceptor prior to its development. The electroluminescent panel 20 is normally off but is cycled on to erase or dissipate the charge on those portions of the photoreceptor between adjacent to image panels. Such erasure of charge precludes the unnecessary retention and cleaning of toner from the photoreceptor in those areas not representing the image to be reproduced. As can be understood, if the timing between the photoreceptor movement and the optics assembly, and activation of the electroluminescent panel is not properly coordinated the development station could apply toner to the photoreceptor for development at areas outside of the imaging panel. Additionally, the electroluminescent panel could also illuminate and erase part of the electrostatic image within the working area. Either of these situations would be undesirable.

The electrostatic image of the photoconductor is presented to development station 22 whereat black or other visible thermoplastic resin powder or toner is selectively deposited on only the charged image areas. This step is effected by charges on the toner particles being opposite from the charges of the electrostatic image so that the toner is attracted and retained on areas of the photoreceptor corresponding to image areas of the original document.

Thereafter, the developed image is transferred to a copy sheet set in synchronism to the photoconductor with the leading edge of the copy sheet in registration with the leading edge of the image panel. Transfer of the toner is effected by electrostatic force, at transfer station 24.

The copy sheet is then passed through fixing station 28 in the form of a hot roll fuser, where heat temporarily liquifies the toner, causing it to adhere to the sheet and to form a permanent image thereon. The copy sheet with the permanent image affixed may now be considered a copy of the original document. The copy is then delivered to exit pocket or tray 42 where it can be removed.

Toner remaining on the photoconductor, as it leaves the transfer station, is removed at cleaning station 26 prior to recharging of the photoconductor in an automatic and continuous cycle of operation.

Copy sheets normally in the form of paper are selectively supplied to path 44 from a primary bin 46 or a secondary bin 48 wherein stacks of cut sheets are stored with their length dimension oriented normal to the direction of sheet feed. These two bins allow the use of sheets of different length, and allow manual selection of a sheet length most nearly corresponding to the length of original document 30.

With reference to document glass 40 upon which original document 30 is placed, all original documents are left-front-corner referenced to a stationary reference corner indicia. The reflection optics, including lens 32, is operable to reflect this reference corner to the back of the photoconductor drum 12 which is rotating clockwise as viewed in FIG. 1.

The original document may be manually positioned on the document glass 40. In such case, the initiation of the copy cycle would be effected by the depression of the Start Print button SP. In the alternative, an automatic document conveyor 50 may be utilized to automatically position one original document on the document glass or to automatically and sequentially transport the contents of a stack of original documents to the document glass. In the case where the automatic document conveyor is employed, a document conveyor button DC would be utilized to initiate the start of the copy cycle as well as to initiate and terminate the conveying of an original document onto the document glass by the automatic document conveyor.

Photoconductor drum 12 may be of the type wherein a flexible photoconductor web is carried on the rigid metallic surface of a drum. The photoconductor is stored in flexible strip form on supply and take-up rolls located within the interior of the photoreceptor drum. The portion of the photoconductor extending between the two rolls encircles the drum and is active in the electrophotographic process. In order to change the active photoconductor portion, a length of the photoconductor is advanced from the supply roll to the take-up roll. The surface of the drum includes an axially extending slot whereat the photoconductor enters and exits the drum's interior. This slot is closed by a seal strip. U.S. Pat. No. 3,588,242 issued to R. A. Berlier et al is an example of such a photoconductor drum structure.

Control of most of the various copy process devices is achieved synchronously with movement of the photoreceptor 12. A drum position transducer T provides a signal output in the form of drum tachs to relay logic, discrete semiconductor logic, and solid state logic in the form of a microcomputer or controller C to achieve proper copier control in a manner well known to those of skill in the art.

The electrophotographic copier device of FIG. 1 as described herein represents the IBM Series III Copier/-Duplicator. Its Service Manual Form No. 241-5928-0, March 1976 is incorporated herein by reference to illustrate the background of the invention and the state of the art as well as further details of the mode of operation of the instant copier. This copier has two image panels and it thus is capable of making two copies of the same original document in one revolution of the photoreceptor or drum 12.

The invention described by the subject application concerns a method and apparatus for synchronizing the movement of the leading edge of a copy sheet to the movement of the leading edge of image panel or functionally equivalent device containing the image. This includes coordinating and adjusting copy sheet gating or the start of feed for the copy sheet advancing toward the photoreceptor. The invention also includes coordinating and adjusting the scanning optics assembly so that the leading edge of the original document is imaged onto the proper point at the leading edge of the image panel of the photoconductor. Additionally, the invention includes the coordinating and adjusting of the registration of a document positioned by an automatic document conveyor so that the conveyor transports and positions the document at the proper place on the document glass.

The first of the above synchronizations occurs by producing an all black copy by virtue of having the scanning optics assembly inactivated. Such inactivation is preferably effected by software through the controller C at the optics assembly controller OA.

If the leading or trailing edge of the produced copy is white: that is, if the electrostatic charge on the image panel has been improperly dissipated by the electroluminescent panel with respect to the movement of the copy sheet, the operator must adjust the gate timing or initiation of the start of copy sheet feed so that the movement of the leading edge of the copy sheet will become synchronized with the movement of the leading edge of the image panel. When such synchronization is not correct and a white strip appears on the copy during inactivation of the optics assembly, adjustments must be made in order to bring the copy sheet to the image panel of the photoreceptor with their leading edges in alignment. Such adjustments may be made by entering software control information via the control panel to the start of scan or gating adjustment logic A1 for electronic adjustment of gate timing, the timing of the start of feed of the copy sheet. Such adjustment may also be made manually by mechanically modifying the gating structures. This adjustment would be made to an extent corresponding to the length of undeveloped area visually determined to be present adjacent to the leading or trailing edge of the copy. If a white strip occurs at the leading edge of the copy, the copy sheet has been fed prematurely and a delay in start of feed would correct the problem. If, on the other hand, the white strip appears at the trailing edge of the copy, the copy sheet has been fed or gated belatedly, and an advance of the start of feed would correct the problem. When the adjustment is effected mechanically following visual observation of the copy, a plurality of copy sheet feeds may be necessary as the correction would be made iteratively by continued trial and error, each copy further improving the synchronism.

It is also possible to determine the deviation from synchronism and to make the proper adjustments by utilizing electronics including an optical sensor 52 in the path of travel of the copy beyond the transfer station and preferably beyond the fuser, as shown in FIG. 1. The optical sensor 52 can determine the length of undeveloped area in the direction of copy movement. Associated control logic including a gate G1 and gating adjustment logic A1 may then be utilized to electronically modify the controller C of the system to appropriately modify the gating of the copy sheet. Start of feed normally occurs through copy sheet gating of the copy sheet to be fed. The scanner adjustment logic A1 will function through gate G1 upon receiving appropriate signals from the optical sensor OS so long as the optics assembly OA is inactivated. It is immaterial as to whether the start of the copying cycle is initiated by the start print button SP or the document conveyor button DC.

Figure 2:
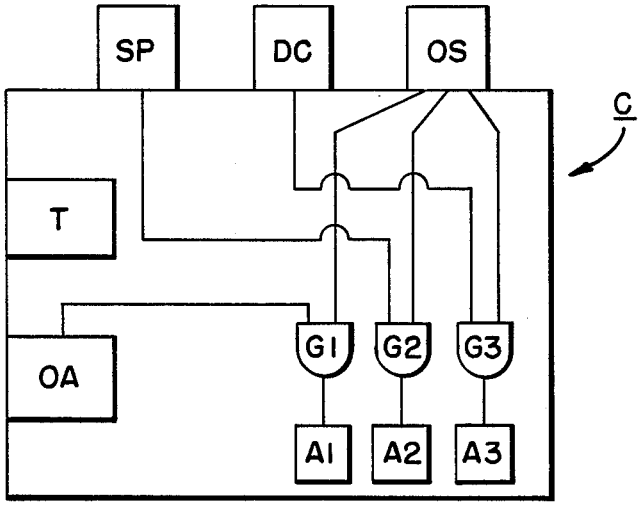
FIG. 2 is a logic diagram illustrating the method of carrying out one embodiment of the present invention.

The optical sensor 52 in FIG. 1 and OS in FIG. 2, is designed to be activated when viewing a white portion of the copy and inactivated when viewing no sheet or a dark patch on the copy. The optical sensor 52 would be polled by the paper path processor of the controller C to determine, by electronic measurement, the distance between the leading white edge of the copy sheet and the dark portion developed in the middle of the sheet. Polling could occur at drum tach interrupts which make the measurement insensitive to drive motor speed variations. In the alternative, polling could occur at the 330 usec timer interrupts concurrently in the paper path processor, which gives finer measurement resolution. A combination of the two polling methods would combine the advantages of both methods but would be more complex to implement in the software code. The synchronizing of the start of feed of the copy sheet to the image panel is thus preferably controlled by counting drum tachs from the image synchronization signal.

Reference is made in this application to an operator carrying out the various method steps of the intended adjustments. Although such steps are not overly complex, such steps and adjustments should preferably be carried out by a customer engineer, someone specially trained in these methods at a facility of the copier manufacturer. However such method steps and adjustments might also be carried out by a casual operator or key operator of the copier with special advance training.

The above adjustment steps are followed by additional steps designed to synchronize the start of scan of the original document to the movement of the image panel, the synchronization of the movement of the image panel and the copy sheet already having been effected. These additional steps first include the reactivation of the optics assembly at its control point OA. Thereafter a master document with dark, preferably black, leading and trailing edges is placed on the document glass with the leading edge properly registered. A copy is then produced. If the copy is determined to be erased at the front or the rear edge creating a white strip on the copy, the scan starting point must be adjusted. A white line adjacent to the leading edge of the copy would indicate that the start of scan began prematurely. A white line at the trailing edge of the copy would indicate that the start of scan began belatedly. The length of such white line would be indicative of the extent of the timing adjustment required. This may be done manually by entering adjustment information through software provided to the control panel for the electronic adjustment at the start of scan adjustment logic A2. The adjustments could also be done mechanically to the optics assembly structures. The length of scan could be determined by visual observation in the manner as discussed hereinabove. The determination of the extent, if any, of the length of the undeveloped area adjacent to the leading or trailing edge may also be done by the optical sensor OS in a manner similar to that as described above. The logic of the controller is such that the output of the optical sensor will adjust the gating adjustment logic A2 through gate G2 when the copying is initiated through the depression of the start print button SP so long as the optics assembly is activated. In this mode of operation, similar to the above described mode, control is effected by counting drum tachs from an image synchronization signal.

Reference is made herein above to a master or original document with dark leading and trailing edges. The color is actually immaterial, so long as it is sufficiently different optically from the normal lighter background of original documents. The darkness of the original document or test master for these adjustment purposes must be sufficient to preclude dissipation of the charge of the photoreceptor during imaging so that the photoreceptor may be developed onto the image panel and then transferred to the copy sheet and the copy sheet sensed by the optical sensor. Similarly, the toner need not be black, but it should be sufficiently dark or different in color from the copy sheet so that its presence or absence may be detected by the optical sensor. Similarly, the test master or original document is preferably entirely dark thereby constituting dark portions adjacent to the leading and trailing edges. The dark portion or portions could, however, be limited to a smaller dark patch or patches within the central area of the test master. The same adjusting results would occur but special software would have to be provided within the controller for coordinated operation of the copier in the adjustment mode.

Following the above steps with the copy sheet gating and start of scan both adjustments of the document conveyor may then be adjusted if the copier is provided with a document conveyor. This adjustment is effected by transporting the above-described test master or original document by the document conveyor 50 to a position on the document glass 40. A copy is then made by initiating the copying cycle through the document conveyor initiation button DC. If the copy has been misregistered by an improperly adjusted document conveyor, a white line will appear at the leading or trailing edge of the copy. If fed too far forward, a line will appear at the trailing edge of the copy while if fed insufficiently, a white line will appear at the leading edge of the copy. If misregistration has occurred, the operator can then visually determine the extent of such misregistration as a function of the length of the white line adjacent to the edge of the copy. The operator may then adjust the document conveyor by the iterative steps manually as described above either electronically through the document conveyor adjustment logic A3 or mechanically through the document conveyor structures. As in the prior adjustments described above, the optical sensor may be employed in determining the length of the undeveloped area, or white line. If the optical sensor is employed, it may directly provide appropriate electronic signals to the document conveyor adjustment logic A3 through the gate G3 so long as the copy cycle has been initiated by the document feeder button DF so long as the optics assembly is activated. These adjustments may effect a slightly greater or slightly lesser conveying of the original document by the document feeder depending on whether the white strip is adjacent to the leading or trailing edge of the copy. In this mode of operation, similar to the above described modes, control is effected by counting servo tachs, in this instance from the document conveyor, from a reference sensor.

The operation and sequencing of the copier of the present invention may be understood by considering the operation and sequencing of the master controller. For these purposes, the master controller may be considered as having three major segments with their three related functions. These are the adjustment of the paper path registration, the adjustment of the optics registration, and the adjustment of the document feeder registration.

The paper path registration begins with a sensing as to whether the copier cover or document glass cover is open. If open, then a message on the operator panel directs the operator to "Close the Cover". The master controller waits until the cover is closed. After the cover is closed, another wait follows while the operator panel displays a message directing the operator to "Please Wait". During this wait, an electrophotography slave controlller is commanded to produce a special registration image with colored or visible areas at least adjacent to the leading and trailing edges. In association therewith, the paper path slave controller is then commanded to feed a sheet from the bottom paper supply to the top exit tray. If a registration sensor is installed, then the paper path slave controller is commanded to measure the white leading and trailing edges with its registration sensor. The wait continues until the paper path slave controller returns the two measurements. If the registration sensor is not installed, then a message is displayed directing the operator to "Measure the White Leading and Trailing Edges and Enter the Values into the Operation Panel". The two measurements are then read by the operator from the operator panel. The gate timing needed to achieve correct paper path registration is then calculated. The new gate timing number is then sent to the paper path slave controller for use with subsequent sheets. If necessary, these steps may be repeated until the paper path registration is correct. The new gate timing value is stored in non-volatile random access memory (RAM) for use when the copier is powered-on again.

The copier master controller for adjusting the optics registration begins with a display on the operator panel of a message directing the operator to "Place the Special Registration Master on the Document Glass." The master controller waits until the document glass cover is opened and then closed.

Another wait then follows while a message is displayed directing the operator to "Please Wait". During this wait, a command is sent to the electrophotography slave controller to produce a normal image. A command is then sent to the optics slave controller to scan the master document normally. Thereafter a command is given to the paper path slave controller to feed a sheet from the bottom paper supply to the top exit tray. If the registration sensor is installed, then a command is given to the paper path slave controller to measure the white leading and trailing edges with its registration sensor. A wait continues until the paper path slave controller returns the two measurements. If the registration sensor is not installed, then a message is displayed on the operator panel directing the operator to "Measure the White Leading and Trailing Edges and Enter the Values into the Operator Panel." The two measurements from the operator panel are then read by the operator. The scan timing needed to achieve correct optics registration is then calculated, and the new scan timing number is then sent to the optics slave controller for use with subsequent scans. These steps may be repeated until the optics registration is correct. The new scan timing value is saved in non-volatile RAM for use when the copier is powered-on again. A message is then displayed on the operator panel directing the operator to "Remove the Document from the Document Glass." Before operating further, the copier waits until the document glass cover is opened and closed.

The copier master controller for adjusting document feeder registration begins with the display of a message on the operator panel directing the operator to "Place the Special Registration Master into the Document Entry Tray." A wait follows until the document feeder slave controller reports a document is at its entry tray. A command is then given to the document feeder slave controller to enter the document onto the document glass. A message is then displayed on the operator panel directing the operator to "Please Wait." During this time, a command is given to the electrophotography slave controller to produce a normal image. A command is also given to the optic slave controller to scan the master document normally. Lastly, a command is also given to the paper path slave controller to feed a sheet from the bottom paper supply to the top exit tray. If the registration sensor is installed, then the paper path slave controller is directed to measure the white leading and trailing edges with its registration sensor. A wait occurs until the paper path slave controller returns the two measurements. If the registration sensor is not installed, then a message is displayed on the operator panel directing the operator to "Measure the White Leading and Trailing Edges and Enter the Values into the Operator Panel." The two measurements from the operator panel are then read by the operator. The entry timing needed to achieve correct document feeder registration are then calculated. The new entry timing number is then sent to the document feeder slave controller for use with subsequent documents. The document feeder slave controller is then commanded to exit the document into the document exit tray. These steps may be repeated until document feeder registration is correct. The new entry timing value is saved in non-volatile RAM for use when the copier is powered-on again. The operator panel will then display a message informing the operator that "Registration Adjustment is Done."

The microcode controlling the apparatus of the present invention is SADL as follows:

---

```
BEGIN SEGMENT (Paper Path Registration)
1.    TEXT

The following segment documents the algorithm executed
by the Copier Master Controller for adjusting Paper
Path registration.

1.    ENDTEXT;
2.    IF a Copier Cover or Document Glass
      Cover is open
1.    THEN
2. .  Display a message directing the
      operator to "Close the Cover";
2. .  Wait until the Cover is closed;
1.    ENDIF;
1.    REPEAT
2.    Display a message directing the
      operator to "Please wait";
2. .  Command the ElectroPhotography Slave
      Controller to produce a special
      registration image with colored
      areas adjacent to the leading and
      trailing edges;
2. .  Command the Paper Path Slave
      Controller to feed a sheet from the
      Bottom Paper Supply to the Top Exit
      Tray;
2. .  IF the Registration Sensor is
      installed
2. .  THEN
3. . . Command the Paper Path Slave
      Controller to measure the white
      leading and trialing edges with
      its Registration Sensor;
3. . . Wait until the Paper Path Slave
      Controller returns the 2
      measurements;
2. .  ELSE
3. . . Display a message directing the
      operator to "Measure the white
      leading and trailing edges and
      enter the values into the
      Operator Panel";
3. . . Read the 2 measurements from the
      Operator Panel;
2. .  ENDIF;
2. .  Calculate the Gate timing needed to
      achieve correct Paper Path
      registration;
2. .  Send the new Gate timing number to
      the Paper Path Slave Controller for
```

-continued

```
      use with subsequent sheets;
1.    UNTIL Paper Path registration is
      correct
1.    ENDREPEAT;
1.    Save the new Gate timing value in
      Non-Volatile RAM for use when the
      copier is powered-on again;

ENDSEGMENT (Paper Path Registration);
BEGIN SEGMENT (Optics Registration)
1.    TEXT

The following segment documents the algorithm executed
by the Copier
Master Controller for adjusting Optics registration.

1.    ENDTEXT;
1.    Display a message directing the
      operator to "Place the special
      Registration Master on the Document
      Glass";
1.    Wait until the Document Glass Cover is opened and
      closed;
1.    REPEAT
2..   Display a message directing the
      operator to "Please Wait";
2..   Command the ElectroPhotography Slave
      Controller to produce a normal
      image;
2..   Command the Optics Slave Controller
      to scan the Master document
      normally;
2..   Command the Paper Path Slave
      Controller to feed a sheet from the
      Bottom Paper Supply to the Top Exit
      Tray;
2..   IF the Registration Sensor is
      installed
2..   THEN
3...  Command the Paper Path Slave
      Controller to measure the white
      leading and trailing edges with
      its Registration Sensor;
3...  Wait until the Paper Path Slave
      Controller returns the 2
      measurements;
2..   ELSE
3...  Display a message directing the
      operator to "Measure the white
      leading and trailing edges and
      enter the values into the
      Operator Panel";
3...  Read the 2 measurements from the
      Operator Panel";
2..   ENDIF;
2..   Calculate the Scan timing needed to
      achieve correct Optics registration;
2..   Send the new Scan timing number to
      the Optics Slave Controller for use
      with subsequent scans;
1.    UNTIL Optics registration is correct
1.    ENDREPEAT;
1.    Save the new Scan timing value in
      Non-Volatile RAM for use when the
      copier is powered-on again;
1.    Display a message directing the
      operator to "Remove the document from
      the Document Glass";
1.    Wait until the Document Glass Cover is
      opened and closed;

ENDSEGMENT (Optics Registration);
BEGINSEGMENT (Feeder Registration)
1.    TEXT

The following segment documents the algorithm executed
by the Copier
Master Controller for adjusting Document Feeder
registration.

1.    ENDTEXT;
1.    REPEAT
```

-continued

```
2..   Display a message directing the
      operator to "Place the special
      Registration Master into the
      Document Entry Tray";
2..   Wait until the Document Feeder Slave
      Controller reports a document at
      its Entry Tray;
2..   Command the Document Feeder Slave
      Controller to enter the document
      onto the Document Glass;
2..   Display a message directing the
      operator to "Please Wait";
2..   Command the ElectroPhotography Slave
      Controller to produce a normal
      image;
2..   Command the Optic Slave Controller
      to scan the Master document
      normally;
2..   Command the Paper Path Slave
      Controller to feed a sheet from the
      Bottom Paper Supply to the Top exit
      Tray;
2..   IF the Registration Sensor is
      installed
2..   THEN
3...  Command the Paper Path Slave
      Controller to measure the white
      leading and trailing edges with
      its Registration Sensor;
3...  Wait until the Paper Path Slave
      Controller returns the 2
      measurements;
2..   ELSE
3...  Display a message directing the
      operator to "Measure the white
      leading and trailing edges and
      enter the values into the
      Operator Panel";
3...  Read the 2 measurements from the
      Operator Panel;
2..   ENDIF;
2..   Calculate the Entry timing needed to
      achieve correct Document Feeder
      registration;
2..   Send the new Entry timing number to
      the Document Feeder Slave
      Controller for use with subsequent
      documents;
2..   Command the Document Feeder Slave
      Controller to exit the document
      into the Document Exit Tray;
1.    UNTIL Document Feeder registration is
      correct
1.    ENDREPEAT;
1.    Save the new Entry timing value in
      Non-Volatile RAM for use when the
      copier is powered-on again;
1.    Display a message informing the
      operator that "Registration
      adjustment is done";

ENDSEGMENT (Feeder Registration);
```

While the present invention has been described as for use on an electrophotographic copier, it should be understood that the present invention works equally well on other similar devices which form colored or visible images on cut sheets and which must align the developed images with the feeding of the cut sheets. Some examples are electrophotographic printers as well as copiers and printers using other processes such as electroerosion and magnetic deposition. On cut sheet electrophotographic printers, the first step of adjusting sheet timing is identical to the copier. The optics mechanism, in this case, a Laser or LED printhead or other equivalent optics mechanism, is deactivated. A latent electrostatic image is produced on the photoreceptor without illumination of an original document. The latent electrostatic image is then developed and the developed image is then transferred to a cut sheet. An internal sensor measures the undeveloped area adjacent to the leading or trailing edge of the cut sheet. Alternatively, an operator can measure the undeveloped area and input the information into the machine through an operator panel. The subsequent gating of cut sheets is adjusted as a function of the measurement value.

The second step of adjusting the optics timing is similar to the copier. The optics mechanism, such as the printhead, is reactivated to produce an image of a special pattern with colored areas adjacent to the leading and trailing edges. With the copier, the special pattern is stored on a special master document. With the printer, the special pattern is stored in computer memory. The developed image is transferred to a cut sheet and the undeveloped areas adjacent to the sheet edges are measured as before. The subsequent timing of optics scanning is adjusted as a function of the measurement value.

The third step of adjusting document feeder timing is not needed with the printer since printers do not use master documents.

The present disclosure includes that information contained in the appended claims as well as that in the foregoing description. Although the invention has been described in its preferred forms or embodiments with a certain degree of particularity, it is understood that the present disclosure of the preferred forms has been made herein only by way of example and that numerous changes in the details of construction, fabrication, and use, including the combination and arrangement of parts, may be resorted to without departing from the spirit and scope of the invention.

What is claimed is:

1. A method for synchronizng the movement of the leading edge of a copy sheet and the movement of the leading edge of an electrostatic image on a photoreceptor in an electrophotographic copier having an optics assembly, comprising the steps of:

inactivating the optics assembly of the copier, initiating the copying cycle of the copier to produce a copy with the optics assembly inactivated, determining the length of undeveloped area adjacent to the leading edge or the trailing edge of the copy, and adjusting the gating of the copy sheet as a function of any such length; and reactivating the optical assembly, positioning a master document with a colored area adjacent to its leading edge and a colored area adjacent to its trailing edge on the document glass of the copier, initiating the copying cycle of the copier to produce a copy, determining the length of undeveloped area adjacent to the leading edge or trailing edge of the copy, and adjusting the start of scan of the optics assembly as a function of any such length.

2. The method as set forth in claim 1 wherein at least one of the determining steps is effected by visual observation.

3. The method as set forth in claim 2 wherein at least one of the adjusting steps is effected manually.

4. The method as set forth in claim 1 wherein at least one of the determining steps is effected automatically by a sensor in the path of travel of the copy.

5. The method as set forth in claim 4 wherein at least one of the adjusting steps is effected automatically in response to the sensor.

6. The method as set forth in claim 1 wherein both of the determining steps are effected by visual observation and wherein both of the adjusting steps are effected manually.

7. The method as set forth in claim 1 wherein both of the determining steps are effected automatically by a sensor in the path of travel of the final copy and wherein both of the adjusting steps are effected automatically by the control system in response to the sensor.

8. The method as set forth in claim 1 and further including the step of:

transporting a master document with a colored area adjacent to its leading edge and a colored area adjacent to its trailing edge by a document conveyor onto the document glass of the copier, initiating the copying cycle of the copier to produce a copy, determining the length of undeveloped area adjacent to the leading edge and trailing edge of the copy, and adjusting the document conveyor as a function of any such length.

9. The method as set forth in claim 8 wherein at least one of the determining steps is effected by visual observation.

10. The method as set forth in claim 9 wherein at least one of the adjusting steps is effected manually.

11. The method as set forth in claim 8 wherein at least one of the determining steps is effected automatically by a sensor in the path of travel of the copy.

12. The method as set forth in claim 11 wherein at least one of the adjusting steps is effected automatically in response to the sensor.

13. The method as set forth in claim 2 wherein all of the determining steps are effected by visual observation and wherein all of the adjusting steps are effected manually.

14. The method as set forth in claim 2 wherein all of the determining steps are effected automatically by a sensor in the path of travel of the final copy and wherein all of the adjusting steps are effected automatically in response to the sensor.

15. In an electrophotographic copier having an optics assembly, apparatus for synchronizing the movement of the leading edge of the copy sheet and the movement of the leading edge of the electrostatic image on the photoreceptor comprising:

optics assembly control means to activate and inactivate the optics assembly of the copier;

start means to initiate the copying cycle of the copier to produce a copy with the optics assembly activated or inactivated;

document glass means to support a master document with a colored area adjacent to its leading edge and a colored area adjacent to its trailing edge;

sensor means to determine the length of undeveloped area adjacent to the leading edge or trailing edge of the copy; and adjustment control means adapted to automatically adjust the gating of the copy sheet in response to the sensor means as a function of any sensed length when the optics assembly is inactivated and to automatically adjust the start of scan of the optics assembly in response to the sensor means as a function of any sensed length when the optics assembly is activated.

16. The apparatus as set forth in claim 15 wherein the sensor means is an optical sensor.

17. The apparatus as set forth in claim 15 and further including:

document conveyor means to transport a master document with a colored area adjacent to its leading edge and a colored area adjacent to its trailing edge onto the document glass of the copier; the adjustment control means also being adapted to automatically adjust the document conveyor means in response to the sensor means as a function of any sensed length when both the document conveyor means and optical assembly are activated.

18. The apparatus as set forth in claim 17 wherein the sensor means is an optical sensor.

19. An electrophotographic copier having an optical assembly comprising:

a photoreceptor movable through a plurality of processing stations;

a charging station whereat a uniform electrostatic charge is deposited onto the photoreceptor;

an exposure station including a document glass for supporting an original document with a colored area adjacent to its leading edge and a colored area adjacent to its trailing edge and whereat light rays reflected from the original document dissipate the charge on an image panel of the photoreceptor in a configuration corresponding to the original document thus creating an electrostatic image;

an erase station whereat an electroluminescent strip dissipates the charge between image panels;

a developing station whereat toner particles are deposited onto the photoreceptor to develop the electrostatic image;

a transfer station whereat toner particles on the photoreceptor are transferred onto a copy sheet;

a copy sheet feed means to convey a copy sheet to an image panel of the photoreceptor with their leading edges in synchronism;

fusing means whereat the toner particles on the copy sheet are permanently affixed thereto for creating the copy of the original document;

an optical sensor in the path of travel of the copy beyond the fusing means to determine the length of the undeveloped area on the copy adjacent to the leading or trailing edge; and adjustment control means responsive to the length determined by the optical sensor to adjust the gating of the copy sheet feed means when the optical assembly is inactivated and to adjust the start of the optical assembly when the optical assembly is activated.

20. The electrophotographic copier as set forth in claim 19 and further including an automatic document conveyor to transport, to a predetermined position on the document glass, an original document with a colored area adjacent to its leading edge and a colored area adjacent to its trailing edge and the adjustment control means is responsive to any such length determined by the optical sensor to adjust the automatic document conveyor when the optical assembly and the document conveyor are both activated.

21. In an electrophotographic copier having an optics assembly, a method for synchronizing the movement of the leading edge of a copy sheet and the movement of the leading edge of an electrostatic image on a photoreceptor, comprising the steps of:

inactivating the optics assembly of the copier, initiating the copying cycle of the copier to produce a copy with the optics assembly inactivated, determining the length of undeveloped area adjacent to the leading edge or the trailing edge of the copy, and adjusting the gating of the copy sheet as a function of any such length.

22. In an electrophotographic copier having an optics assembly, a method for synchronizing the movement of the leading edge of a copy sheet and the movement of the leading edge of an electrostatic image on a photoreceptor, comprising the steps of:

positioning a master document with a colored area adjacent to its leading edge and a colored area adjacent to its trailing edge on the document glass of the copier, initiating the copying cycle of the copier to produce a copy, determining the length of undeveloped area adjacent to the leading edge or trailing edge of the copy, and adjusting the start of scan of the optics assembly as a function of any such length.

23. In an electrophotographic copier, a method for synchronizing the movement of the leading edge of a copy sheet and the movement of the leading edge of an electrostatic image on a photoreceptor, comprising the steps of:

transporting a master document with a colored area adjacent to its leading edge and a colored area adjacent to its trailing edge by a document conveyor onto the document glass of the copier, initiating the copying cycle of the copier to produce a copy, determining the length of undeveloped area adjacent to the leading edge or trailing edge of the copy, and adjusting the document conveyor as a function of any such length.

24. In an electrophotographic copier having an optics assembly, apparatus for synchronizing the movement of the leading edge of the copy sheet and the movement of the leading edge of the electrostatic image on the photoreceptor, comprising:

optics assembly control means to activate and inactivate the optics assembly of the copier;

start means to initiate the copying cycle of the copier to produce a copy with the optics assembly activated or inactivated;

sensor means to determine the length of undeveloped area adjacent to the leading edge or trailing edge of the copy; and adjustment control means adapted to automatically adjust the gating of the copy sheet in response to the sensor means as a function of any sensed length when the optics assembly is inactivated.

25. In an electrophotographic copier having an optics assembly, apparatus for synchronizing the movement of the leading edge of the copy sheet and the movement of the leading edge of the electrostatic image on the photoreceptor, comprising:

start means to initiate the copying cycle of the copier to produce a copy;

document glass means to support a master document with a colored area adjacent to its leading edge and a colored area adjacent to its trailing edge;

sensor means to determine the length of undeveloped area adjacent to the leading edge or trailing edge of the copy; and adjustment control means adapted to automatically adjust the start of scan of the optics assembly in response to the sensor means as a function of any sensed length.

26. In an electrophotographic copier, apparatus for synchronizing the movement of the leading edge of the copy sheet and the movement of the leading edge of the electrostatic image on the photoreceptor, comprising:

start means to initiate the copying cycle of the copier to produce a copy;

document glass means to support a master document with a colored area adjacent to its leading edge and a colored area adjacent to its trailing edge;

sensor means to determine the length of undeveloped area adjacent to the leading edge or trailing edge of the copy;

document conveyor means to transport a master document with a colored area adjacent to its leading edge and a colored area adjacent to its trailing edge onto the document glass of the copier, and adjustment control means adapted to automatically adjust the document conveyor means in response to the sensor means as a function of any sensed length.

27. In a device having an optics mechanism for forming visible images on cut sheets, a method for synchronizing the movement of the leading edge of a cut sheet and the movement of the leading edge of an electrostatic image on the photoreceptor of the device, comprising the steps of:

inactivating the optics mechanism of the device, initiating the operating cycle of the device to produce a visible image on a cut sheet with the optics mechanism inactivated, determining the length of undeveloped area adjacent the leading or the trailing edge of the cut sheet, and adjusting the gating of the cut sheet as a function of any such length.

28. The method as set forth in claim 27 and further including the steps of:

reactivating the optics mechanism of the device to create a visible image at least at the leading and trailing edges of the cut sheet, determining the length of undeveloped area adjacent the leading or the trailing edge of the cut sheet, and adjusting the optics mechanism as a function of any such length.

29. In a device having an optics mechanism for forming visible images on cut sheets, apparatus for synchronizing the movement of the leading edge of the cut sheet and the movement of the leading edge of an electrostatic image on the photoreceptor of the device, comprising:

means to inactivate the optics mechanism of the device, means to initiate the operating cycle of the device to produce a visible image on a cut sheet with the optics mechanism inactivated, means to determine the length of undeveloped area adjacent the leading or the trailing edge of the cut sheet, and means to adjust the gating of the cut sheet as a function of any such length.

30. The apparatus as set forth in claim 29 and further including:

means to reactivate the optics mechanism of the device to create a visible image at least at the leading and trailing edges of the cut sheet, means to determine the length of undeveloped area adjacent the leading or the trailing edge of the cut sheet, and means to adjust the optics mechanism as a function of any such length.

* * * * *